US006010351A

United States Patent [19]

Kuboto

[11] Patent Number: 6,010,351

[45] Date of Patent: Jan. 4, 2000

[54] CONNECTOR CONNECTING STRUCTURE OF A JUNCTION BOX

[75] Inventor: Mitsuji Kuboto, Shizuoka, Japan

[73] Assignee: Yazaki Corporation, Tokyo, Japan

[21] Appl. No.: 08/997,883

[22] Filed: Dec. 24, 1997

[30] Foreign Application Priority Data

Dec. 26, 1996 [JP] Japan ..... 8-348706

[51] Int. Cl.[7] ..... H01R 13/625

[52] U.S. Cl. ..... 439/347

[58] Field of Search ..... 439/347, 310, 439/152–160

[56] References Cited

U.S. PATENT DOCUMENTS 5,575,676 11/1996 Tsukakoshi et al. ..... 439/347
5,816,833 10/1998 Hanazaki ..... 439/157

FOREIGN PATENT DOCUMENTS 3-84566 8/1991 Japan .
3-100378 10/1991 Japan .
6-70424 9/1994 Japan .
6-49064 12/1994 Japan .

*Primary Examiner*—Steven L. Stephan
*Assistant Examiner*—Eugene G. Byrd
*Attorney, Agent, or Firm*—Armstrong, Westerman, Hattori, McLeland and Naughton

[57] ABSTRACT

A connector connection structure of a junction box is provided. In this structure, junction box assembling and connector connecting can be performed at the same time. A rear cover which is slidable in the direction of connector engagement is temporarily engaged with the main body of the junction box. Connectors are engaged with connector housing, with the terminals of the connectors are unconnected to terminals of the substrate. When securing the main body to the bracket with a bolt, the rear cover is brought into contact with the bracket and moves in a relative direction of the connector engagement so as to connect the connector terminals to the substrate terminals. The main body is provided with a long slit having a tapered wall on which the head of the bolt slides to press the main body. Slide protrusions are formed on the main body, and guide slits having tapered portions are formed on the bracket.

6 Claims, 9 Drawing Sheets

CONNECTOR CONNECTING STRUCTURE OF A JUNCTION BOX

BACKGROUND OF THE INVENTION

1. Field of the Invention

The present invention relates to a connector connecting structure of a junction box in which the junction box is secured to a bracket with a bolt, and connectors of a wire harness are connected to the rear cover of the junction box.

2. Related Art

Connectors can be connected to a junction box (hereinafter referred to as J/B) either by hand or by screws. Connector engagement may be unreliable when relying upon human hands, because there may be imperfect engagement or he/she may forget to connect the connectors at all. Also, since there is a limit to human power in pressing the connectors, multipolar connectors cannot be employed. As a result, the J/B tends to be undesirably large.

If the connectors are multipolar, the junction box needs to be engaged by screws. For instance, a connector connecting structure of a junction box shown in FIG. 9 (disclosed in Japanese Patent Publication No. 6-49064) has been employed.

In such structure, a plurality of female connectors 51 are connected to a J/B main body 50 from below. A plurality of male connectors 52 corresponding to the male connectors 51 are engaged with connector housings 53, and the connector housings 53 are temporarily engaged with the J/B main body from above. By tightening a bolt 54 to secure the connector housings 53 to a nut 55 of the J/B main body, the male connectors 52 are engaged with the female connectors 51. Wire harnesses 56 and 57 are connected to the female connectors 51 and the male connectors 52, respectively. A J/B 58 is made up of the J/B main body 50, the female connectors 51, the connector housings 53, and the male connectors 52.

In the above conventional structure, however, it is necessary to employ a protector for preventing interlock or a jig for tightening a screw. For instance, if the J/B 58 is arranged in a small space inside an instrument panel of a vehicle, the screw cannot be tightened. There is another problem that the production cost is unreasonably high, because it is necessary to employ various parts such as the bolt 54 and the nut 55 for screwing engagement.

SUMMARY OF THE INVENTION

The object of the present invention is to provide a connector connecting structure of a junction box which requires no screwing devices for connector engagement, is adaptable in a small space, and prevents a cost increase.

To achieve the above object, the present invention provides a connector connecting structure of a junction box (J/B). This structure comprises a J/B main body, a J/B rear cover provided on the J/B main body, terminals of circuit substrate of the J/B main body arranged in connector housings of the J/B rear cover, connectors of a wire harness engaged with the connector housings, and an assembly bolt for securing the junction box to a bracket. In such structure, the J/B rear cover is slidable in the direction of connector engagement, the J/B rear cover is temporarily engaged with the J/B main body at a distance from the circuit substrate, the connectors are engaged with the connector housings, terminals of the connectors are unconnected to terminals of the circuit substrate, and the J/B rear cover being brought into contact with the bracket and moving in a direction relative to the connector engagement direction so as to connect the connector terminals to the circuit substrate terminals, when clamping the J/B main body to the bracket with the assembly bolt.

In another embodiment of the present invention, the J/B main body has a tapered wall which is provided with a long slit for receiving the assembly bolt, and the spacer on the head of the assembly bolt slides on the tapered wall so as to press the J/B main body in a direction perpendicular to the tapered wall. In yet another embodiment of the present invention, the J/B main body is provided with slide protrusions, and the bracket is provided with guide slits having tapered portions for receiving the slide protrusions.

When the connectors of a wire harness are connected to the connector housings of the J/B rear cover, the terminals are unconnected and separate from each other. By screwing the assembly bolt, the J/B rear cover is brought into contact with the bracket and pushed in a direction relative to the connector engagement. In other words, the J/B main body moves toward the J/B rear cover in the direction of terminal connection. By doing so, the terminals of the circuit substrate are respectively connected to the terminals inside the connectors.

As the spacer comes into contact with the tapered wall when screwing the bolt, the J/B main body is pushed in a direction perpendicular to the tapered wall and moves along the guide slits. When the tapered portions of the guide slits are brought into contact with the slide protrusions, the J/B main body moves in the direction of terminal connection. The J/B main body is locked when the slide protrusions have reached the edges of the guide slits, so that the J/B is secured to the bracket by virtue of the slide protrusions.

The above and other objects and features of the present invention will be more apparent from the following description taken in conjunction with the accompanying drawings.

DESCRIPTION OF THE PREFERRED EMBODIMENTS

Figures 1, 1A:
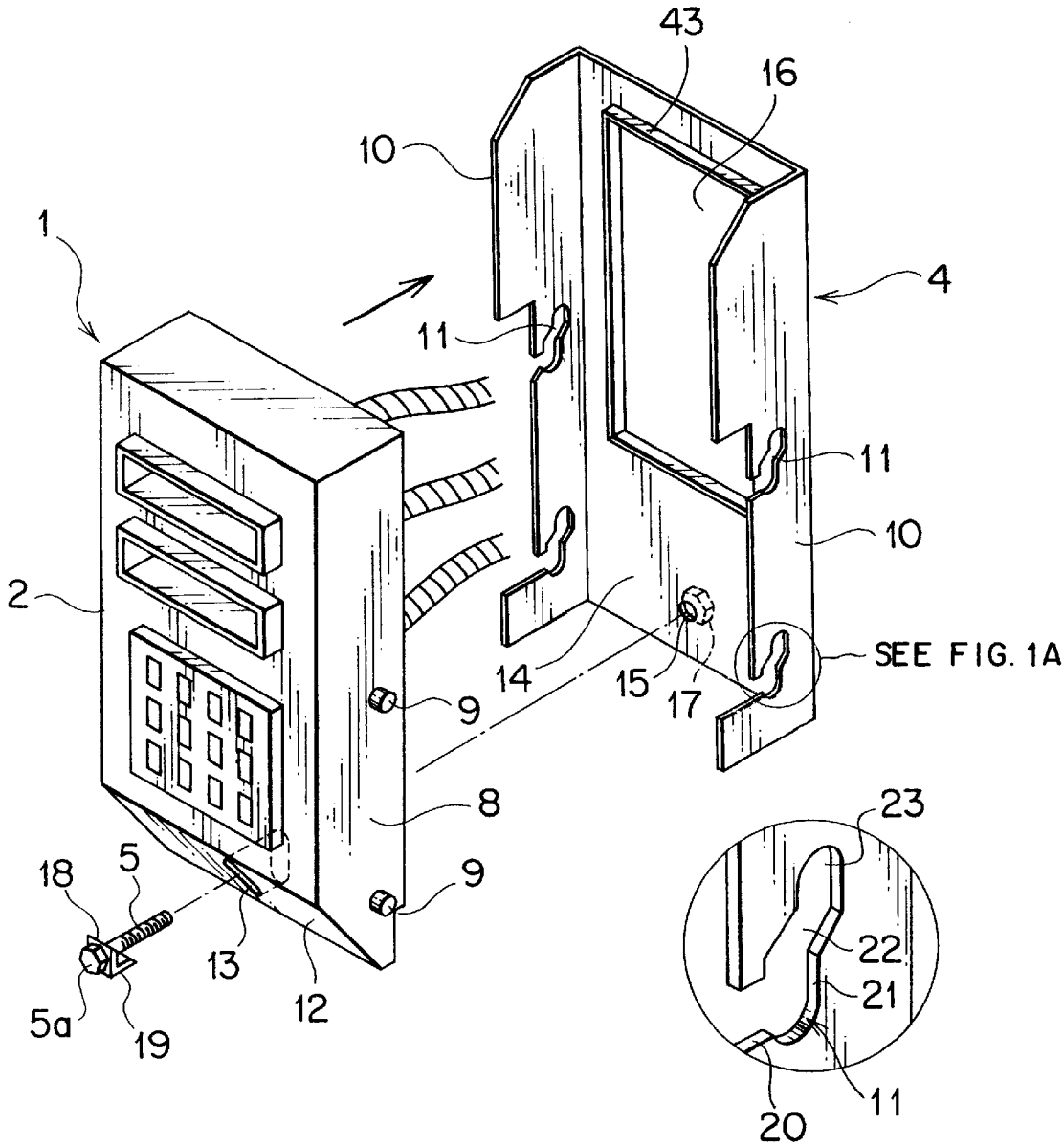
FIG. 1 is an exploded perspective view of an embodiment of a connector connecting structure of a junction box of the present invention.

The following is a detailed description of embodiments of the present invention with reference to the accompanying drawings.

FIGS. 1 to 6 shown embodiment of a connector connecting structure of a junction box according to the present invention.

In this embodiment, a junction box 1 (hereinafter referred to as J/B 1) is attached to a bracket 4 on the side of an instrument panel with a bolt 5, while a circuit substrate 6 (shown in FIG. 3) in a J/B main body 2 is connected to a wire harness 7 of a vehicle from the side of a J/B rear cover 3.

Figure 2:
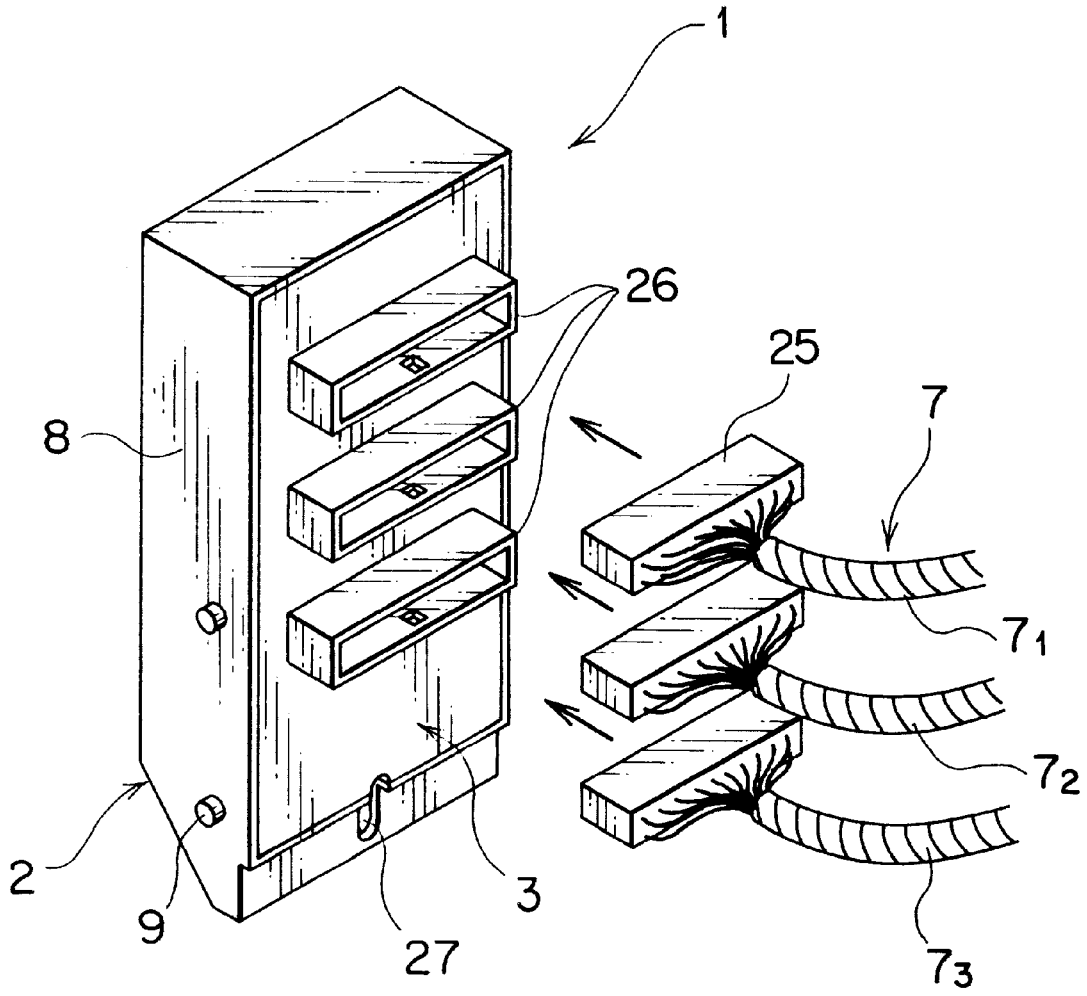
FIG. 2 is an exploded perspective view illustrating how connectors are engaged with the J/B rear cover of the junction box.

As shown in FIG. 2, the J/B 1 consists of the J/B main body 2, the J/B rear cover 3, and the bus bar circuit substrate 6 (shown in FIG. 3) provided inside the J/B main body 2. A pair of slide protrusions 9 are provided on both side walls 8 of the J/B main body 2, and a pair of guide slits 11 corresponding to the slide protrusions 9 are formed on both side walls of the bracket 4, as shown in FIG. 1.

A tapered wall 12 is provided on one side of the J/B main body 2, and a slit 13 for receiving the assembly bolt 5 is provided on the tapered wall 12. On the bottom of the bracket 4, an insert hole 15 for bolt 5 is formed for receiving the assembly, and an opening 16 is provided for accommodating the vehicle-side wire harness 7 (consisting of a front wire harness $7_1$, a cowl wire harness $7_2$, and a rear wire harness $7_3$). A nut 17 is secured to the rear side of the insert hole 15.

An L-shaped spacer 19 having a contact portion 18 for the tapered wall 12 is provided on the head portion 5*a* of the assembly bolt 5. This spacer 19 may have a tapered contact wall 18 to meet with the tapered wall 12. It may also be a simple washer.

The slit 13 extends in the longitudinal direction of the J/B main body 2, and so do the guide slits 11 of the bracket 4. Each of the guide slits 11 consists of a first straight vertical portion 21 extending to an inlet portion 20, a tapered portion 22 extending to the first vertical portion 21, and a second straight vertical portion (ora lock portion) 23 extending to the tapered portion 22. Both vertical portions 21 and 23 are situated in parallel with the bottom wall 14 of the bracket 4.

As shown in FIG. 2, a plurality of female connector housings 26 for receiving male connectors 25 of the vehicle-side wire harness 7 are integrally formed on the J/B rear cover 3. A slit 27 for bolt insertion is formed in the vicinity of the edge portion of the J/B rear cover. The J/B rear cover 3 is temporarily fixed to the J/B main body 2.

Figure 3:
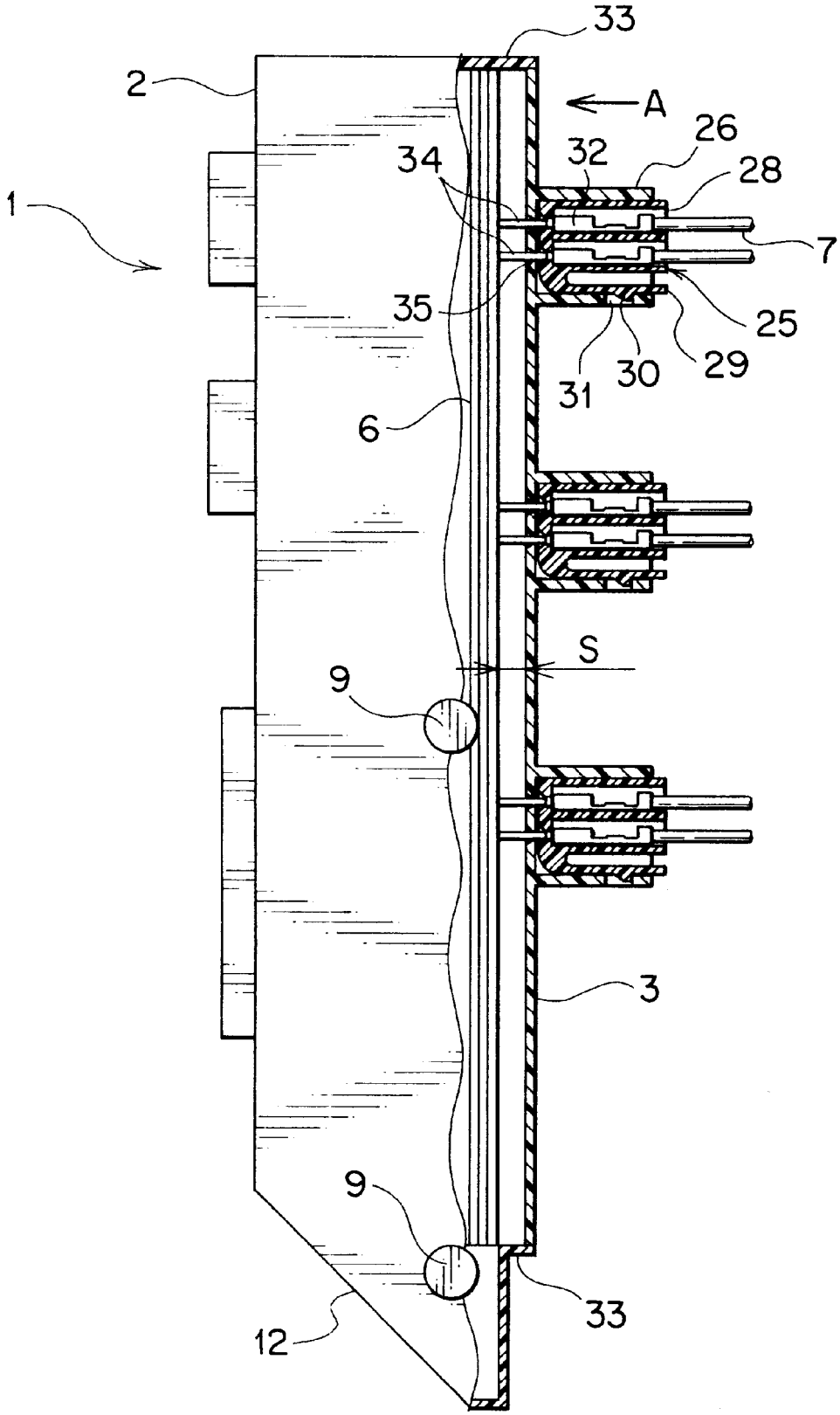
FIG. 3 is a partially sectional view illustrating how the rear cover is temporarily engaged with the main body of the junction box.

As shown in FIG. 3, the male connectors 25 of the wire harness 7 are engaged with the female connector housings 26 on the J/B rear cover 3. Each male connector housing 28 has a flexible lock arm 29, and a lock protrusion 30 of the lock arm 29 is engaged with an engaging hole 31 of the female connector housing 26. A plurality of female terminals 32 which extend to the wire harness 7 are held inside each of the male connector housings 28. Such female terminals 32 constitute each male connector 25.

The J/B rear cover 3 is temporarily engaged with the inside of the frame wall 33 of the J/B main body 2. Here, the J/B rear cover 3 is slidable in the connector engagement direction (indicated by the arrow A), and it is set afloat on the bottom side of the J/B main body 2. Between the bus bar circuit substrate 6 fixed inside the J/B main body 2 and the J/B rear cover 3, there is a gap S kept for terminal connecting strokes. The J/B rear cover 3 may be temporarily secured to the J/B main body 2 with an engaging device which is not shown in the accompanying drawings. Male terminals (bus bar terminals) 34 protrude from the circuit substrate 6 inside the J/B main body 2 toward the J/B rear cover 3. The male terminals 34 penetrate through terminal insert holes 35, and the end portions of them are situated inside the female connector housings 26. The male terminals 34 are yet to be connected to the female terminals 32.

Figure 4:
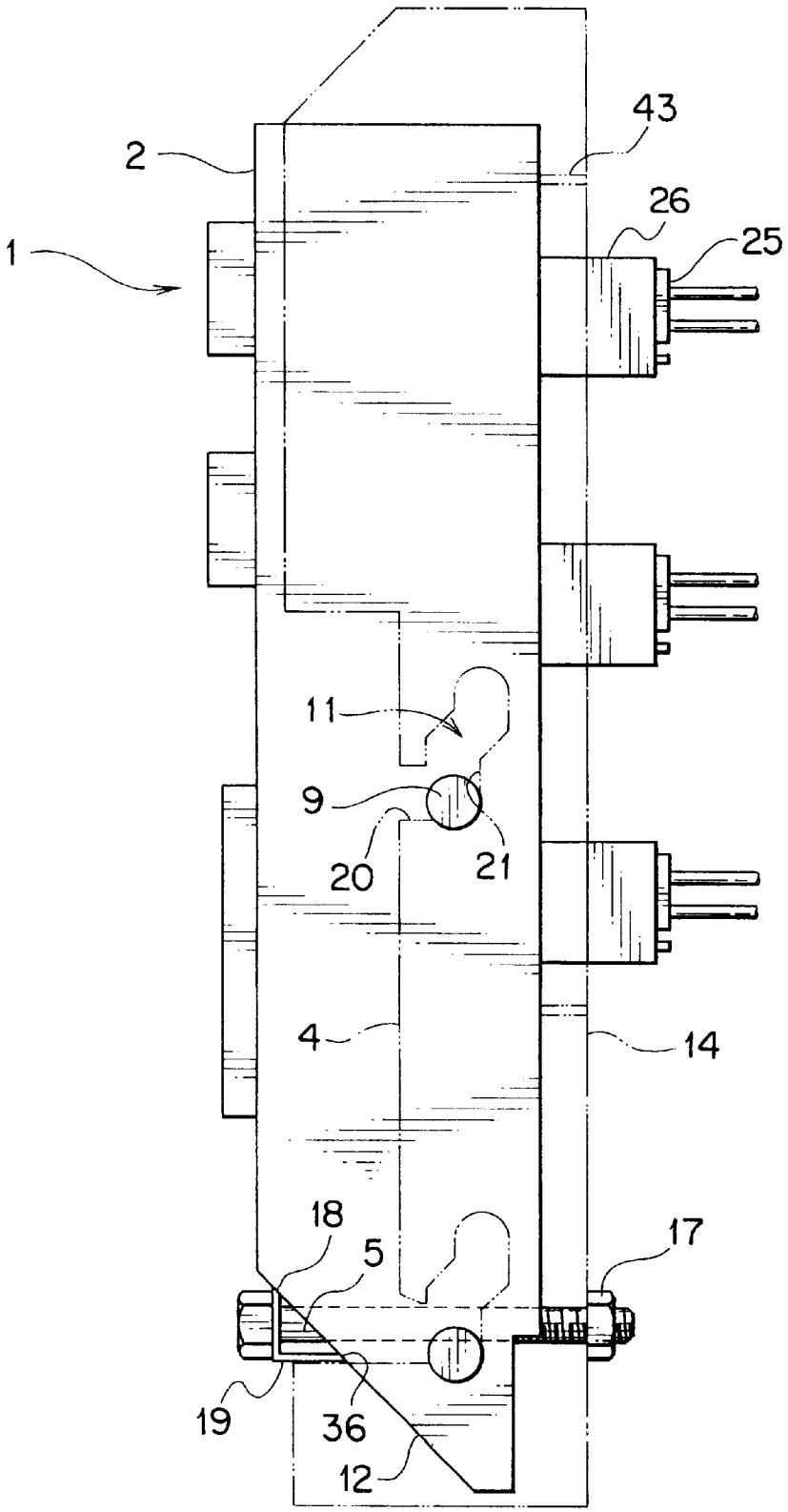
FIG. 4 is a side view illustrating how the junction box is temporarily engaged with a bracket.

FIG. 4 shows how the J/B 1 is temporarily engaged with the bracket 4. Each of the slide protrusions 9 of the J/B main body 2 go past the inlet portion 20 and are held at the first vertical portion 21 of each of the guide slit 11. The position of the J/B rear cover 3 remains as shown in FIG. 3, and the male terminals 34 of the circuit substrate 6 are not connected to the female terminals 32, also as shown in FIG. 3. Here, the assembly bolt 5 is inserted into the slit 13 of the J/B main body 2 and screwed into the nut 17 of the bracket 4. The edge portions 18 and 36 of the spacer 19 inserted onto the bolt 5 are brought into contact with the tapered wall 12 of the J/B main body 2 so as to support the bolt 5 perpendicularly.

Figure 5:
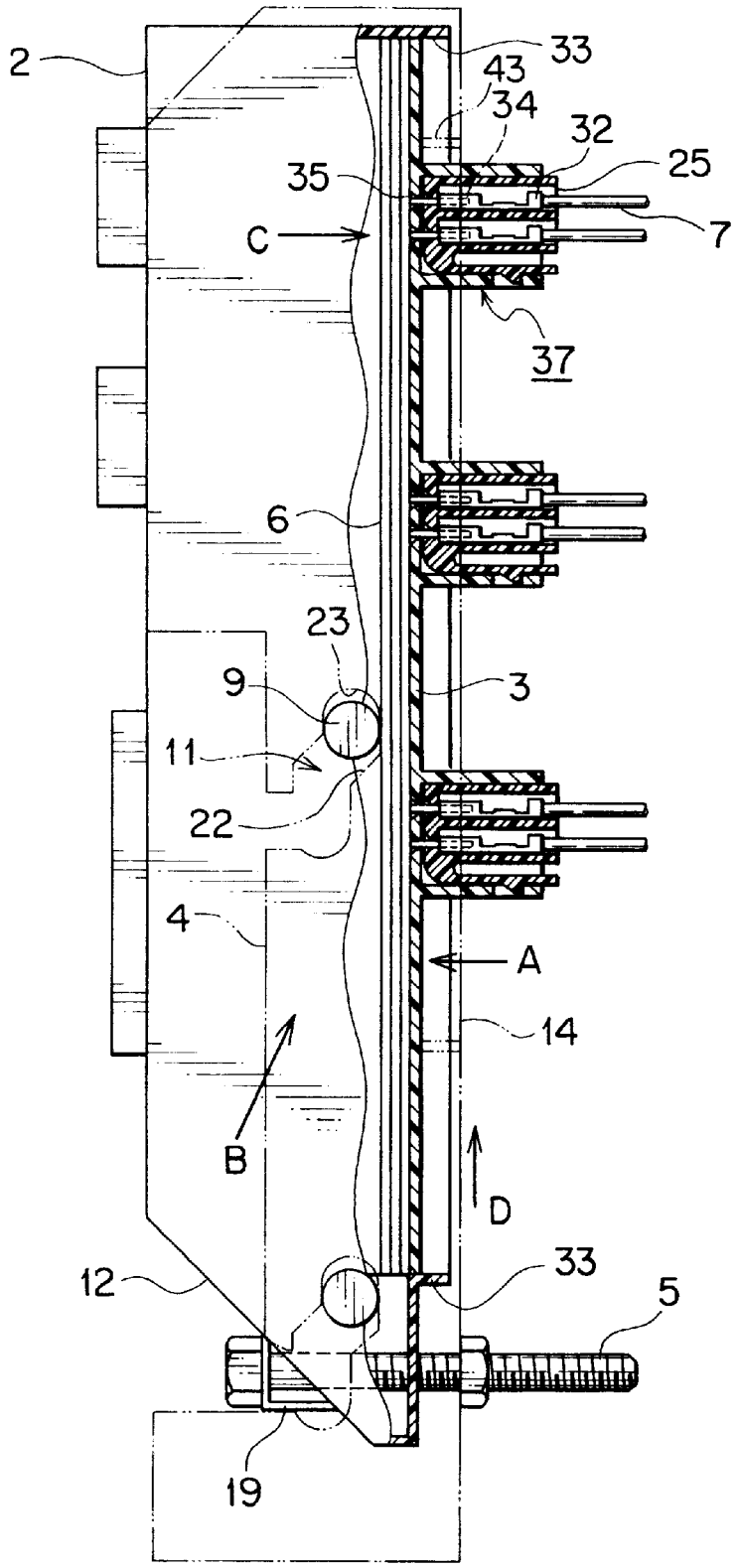
FIG. 5 is a partially sectional view illustrating how the junction box is secured to the junction box with a bolt.

By inserting the bolt 5, the J/B main body 2 is pressed by the spacer 19 in the direction perpendicular to the tapered wall 12, as shown in FIG. 5. Accordingly, the slide protrusions 9 move along with the guide slits 11 in a horizontal or inclined direction, and the J/B main body 2 moves toward the bottom wall 14 of the bracket 4. The slits 13 and 27 (shown in FIGS. 1 and 2) of the J/B 1 move along with the bolt 5.

Meanwhile, the J/B rear cover 3 is brought into contact with the bottom wall 14 of the bracket 4, and pressed toward the inside of the J/B main body 2 as indicated by the arrow A. Accordingly, the J/B rear cover 3 moves along the frame wall 33 in a relative direction of the connector engagement, and stops when it comes in contact with the circuit substrate 6. The male terminals 34 of the circuit substrate 6 protrude through the insert holes 35 of the J/B rear cover 3 toward the inside of the female connector housings 26. The male connectors 25 of the wire harness 7 move together with the J/B rear cover 3, and as a result, the female terminals 32 of the male connectors 25 are engaged with, and connected to, the male terminals 34 of the circuit substrate 6. The male terminals 34 are held in the female connector housings 26 to form female connectors 37.

When the J/B rear cover 3 moves in a direction relative to the connector engagement direction, the J/B rear cover 3 comes in contact with the bottom wall 14 of the bracket 4, and the J/B main body 2 moves along the guide slits 11 toward the J/B rear cover 3 in the terminal connection direction (indicated by the arrow C).

Here, the J/B rear cover 3 slides on the bottom wall 14, and moves in synchronization with the J/B main body 2 in the vertical direction as indicated by the arrow D. Protrusions 43 which push the J/B rear cover 3 into the J/B main body 2 are formed on the bottom wall 14 of the bracket 4.

Each of the slide protrusions 9 is engaged with the second vertical portion 23 via the first vertical portion 21 and the tapered portion 22 of each guide slit 11. By locking the slide protrusions 9 as above, the J/B 1 can be secured to the bracket 4. Even if there is only one bolt 5, and if the bolt 5 is situated on the edge portion of the J/B 1, the J/B 1 can be surely secured. Such effect is obtained by employing the tapered guide slits 11.

Figure 6:
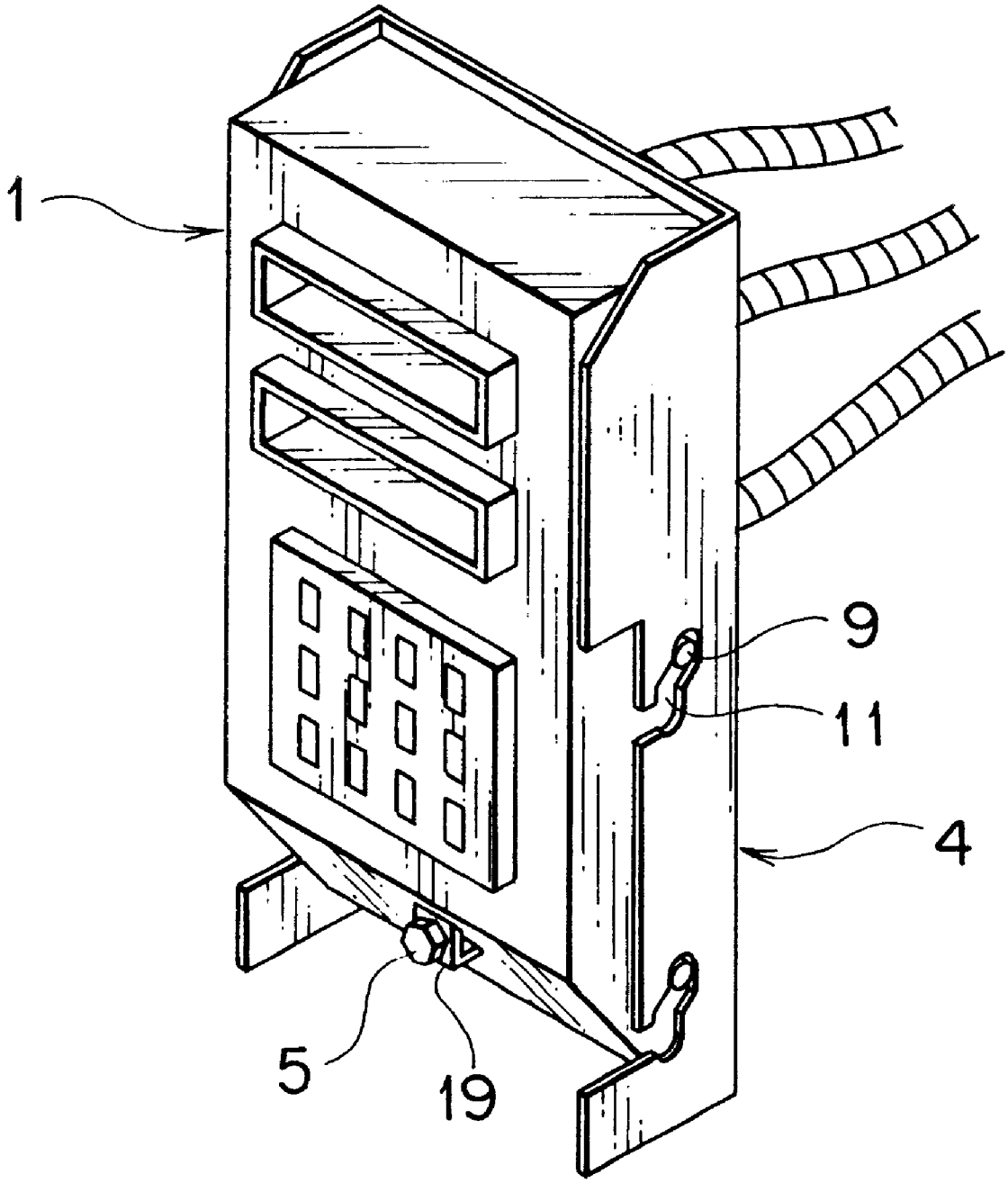
FIG. 6 is a perspective view illustrating how the junction box is secured.

When pushed into the J/B main body 2, the J/B rear cover 3 may be permanently engaged with the J/B main body 2 by a permanent engagement device (not shown). The J/B 1 is secured to the bracket 4 with the assembly bolt 5. The assembly secured state of the J/B 1 to the bracket 4 is shown in FIG. 6.

Figure 7:
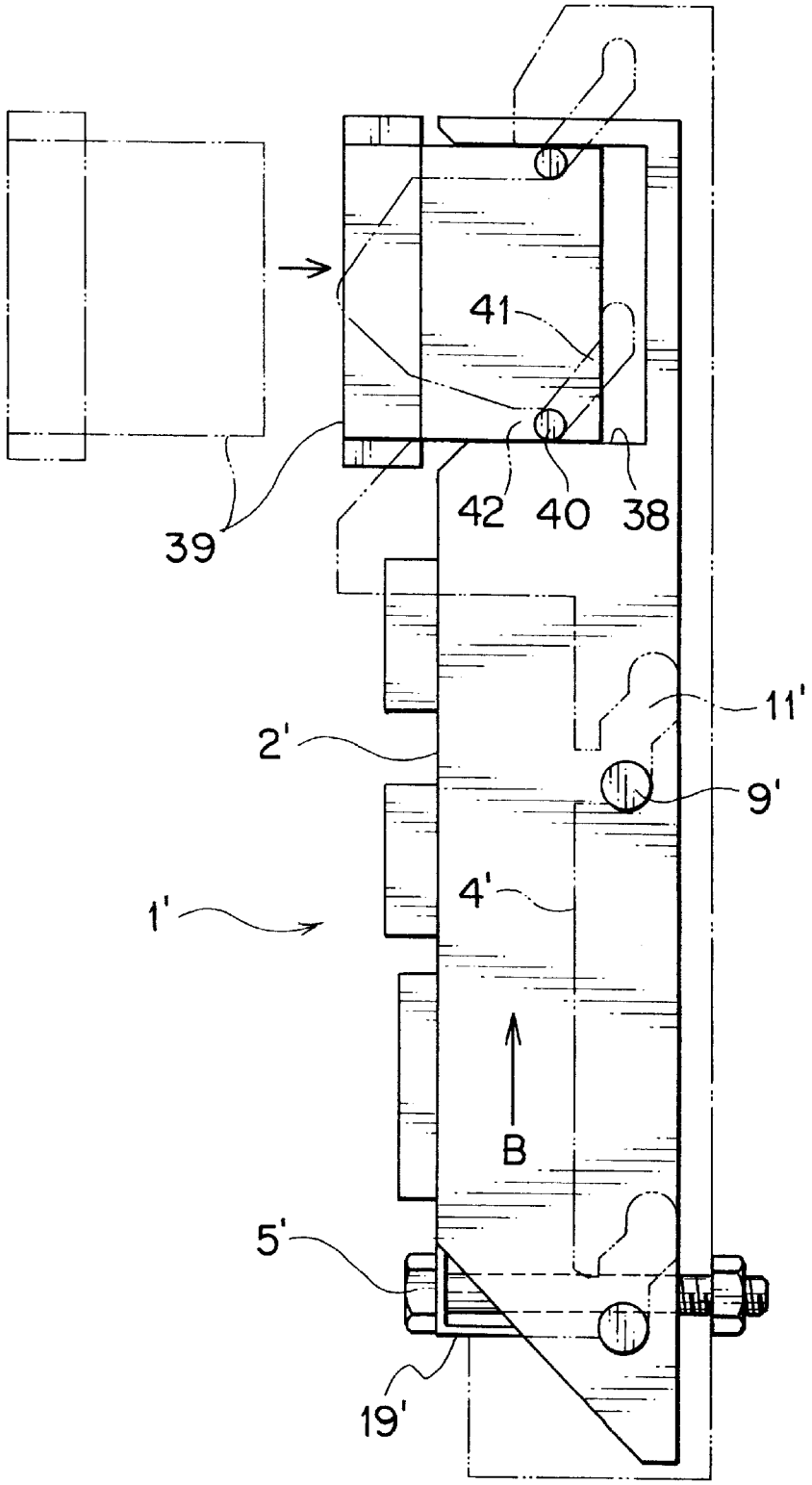
FIG. 7 is a side view of another embodiment of a connector connecting structure of a junction box.
Figure 8:
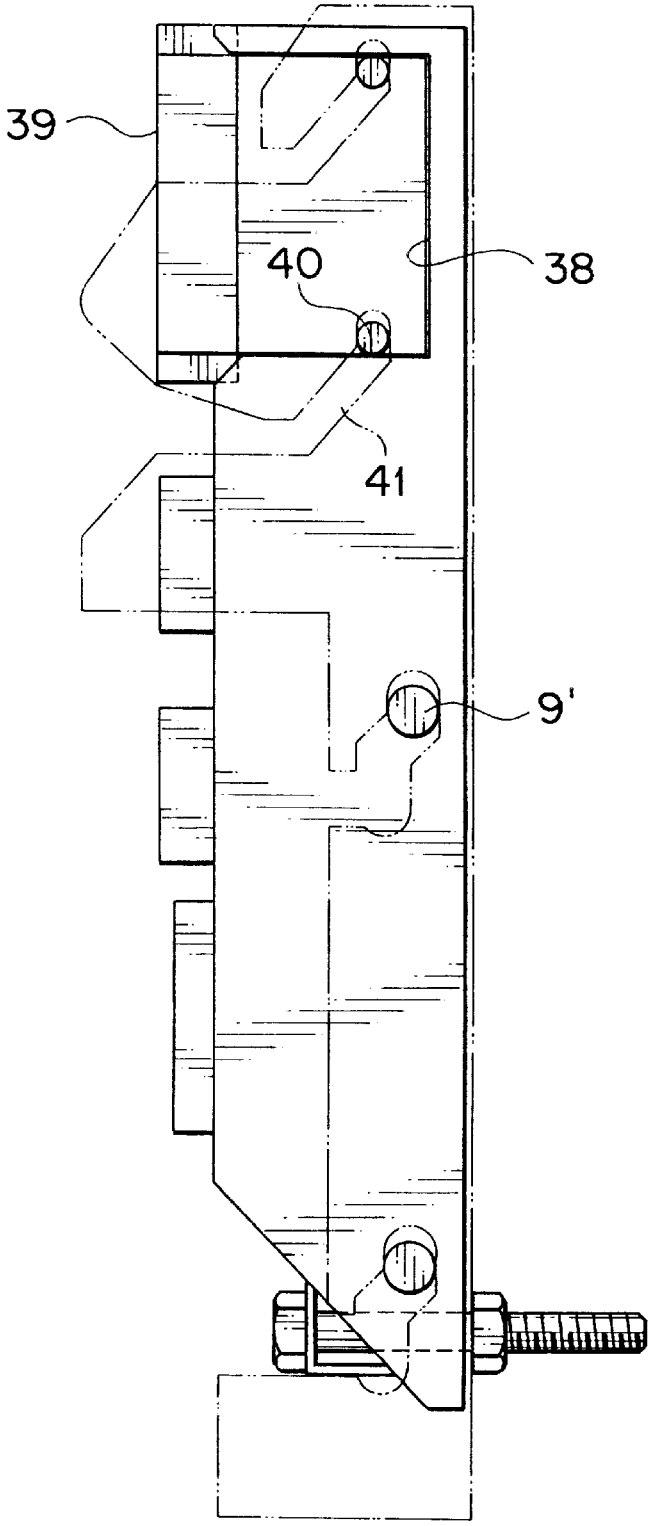
FIG. 8 is a side view illustrating how connectors are engaged with the junction box.
Figure 9:
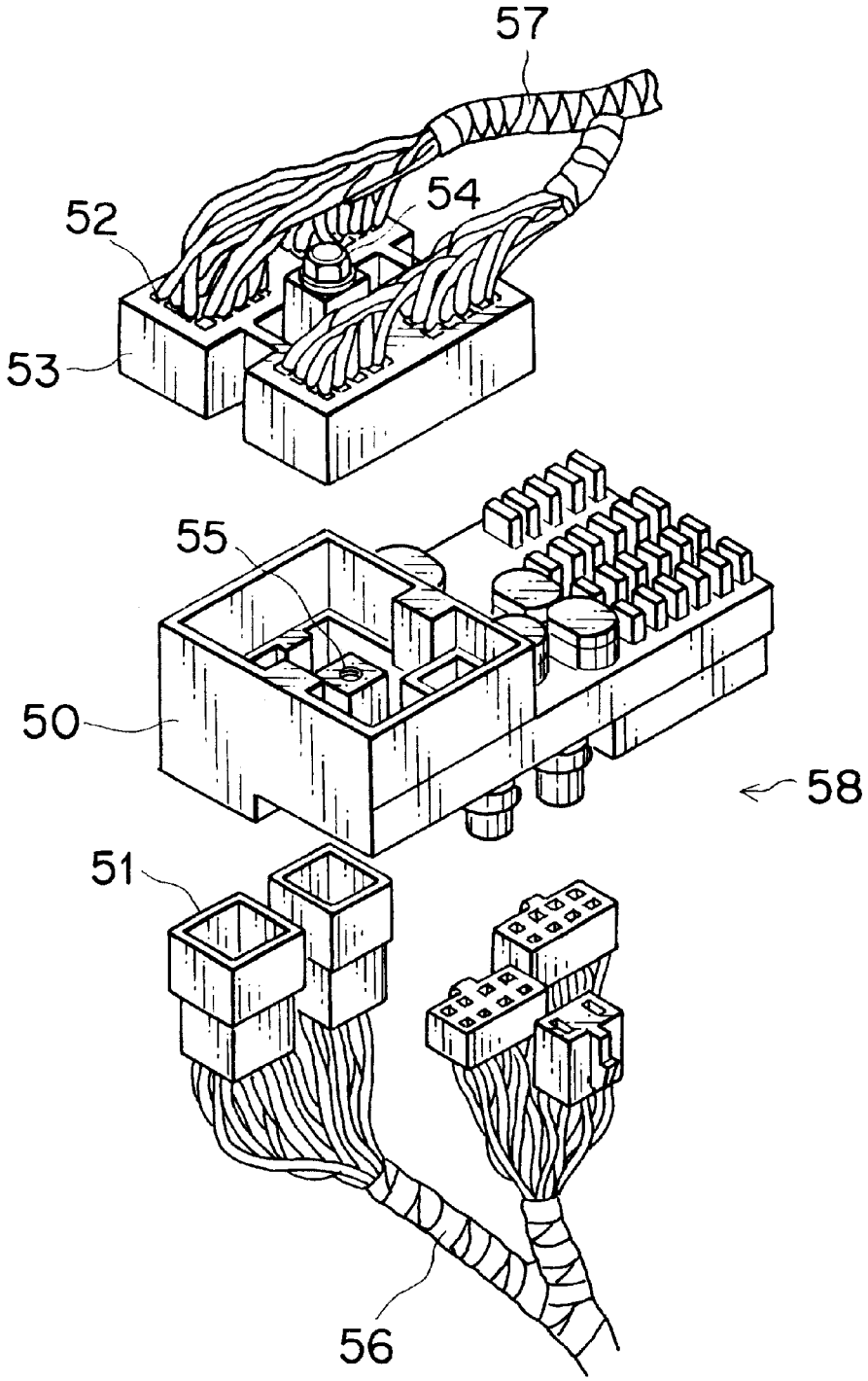
FIG. 9 PRIOR ART
FIG. 9 is an exploded perspective view of a connector connecting structure of the prior art.

FIGS. 7 and 8 show another embodiment of the connector connecting structure of a J/B.

The differences between the first embodiment and this embodiment are that a female connector 38 is formed on a J/B main body 2', that a slide protrusion 40 is formed on a male connector 39 corresponding to the female connector 38, and that a tapered second guide slit 41 for guiding the slide protrusion 40 is formed on a bracket 4' for securing the J/B 1'. The second guide slit 41' is tapered in the same direction as a first guide slit 11' for guiding a slide protrusion 9'.

In FIG. 7, the male connector 39 is initially engaged with a female connector 38, and the slide protrusion 40 is situated at the input portion 42 of the second guide slit 41. By tightening the assembly bolt 5', the J/B 1' is pushed by a spacer 19' and moves along the first guide slit 11' as indicated by the arrow B. The slide protrusion 40 moves along the second guide slit 41, so that the male connector 39 is engaged with the female connector 38.

As described so far, the present invention can be applied to multipolar connectors, because according to the present invention, connectors of a wire harness can be easily engaged with connector housings of a J/B rear cover by hand, and terminals can be surely connected to each other by tightening an assembly bolt. Since the bolt tightening position and the connector position are different, there is no need to employ a protector for preventing wrong engagement, and the J/B can be positioned in a small space, such as an instrument panel. By securing the J/B by an assembly bolt and connecting the connectors at the same time, the need for a conventional screw for engaging connectors is eliminated. Any additional parts and special processes for connecting connectors are not necessary, either. Thus, increases in cost and the number of processes can be prevented.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. A connector connecting structure of a junction box, comprising:

a main body;

a circuit substrate carried by said main body;

a rear cover provided on said main body, said rear cover being slidable in connector engagement and disengagement directions;

said circuit substrate of said main body having terminals arranged in connector housings on said rear cover;

connectors of a wire harness engaged with said connector housings and having terminals matable with, said terminals of said circuit substrate;

a bracket for mounting said junction box;

cooperable locking elements including a first element on one of said main body and said bracket and a second element on the other of said main body and said bracket connectable to said first element when said main body is moved; and an assembly bolt for securing the junction box to said bracket, said rear cover being brought into contact with said bracket and moved by said assembly bolt in the connector engagement direction so as to connect said connector terminals to said circuit substrate terminals, when securing said main body to said bracket.

2. A connector connecting structure of a junction box according to claim 1, wherein a tapered wall is formed on said main body, a long slit for inserting said assembly bolt is formed through said tapered wall, and a spacer provided on a head of said assembly bolt slides on said tapered wall so as to press the main body in a direction perpendicular to said tapered wall for engaging said locking elements.

3. A connector connecting structure of a junction box according to claim 2, wherein said spacer is L-shaped and has a slide contact portion which is brought into contact with said tapered wall.

4. A connector connecting structure of a junction box according to claim 2, wherein said locking elements include slide protrusions on said main body, and partially tapered guide slits on said bracket for receiving said slide protrusions.

5. A connector connecting structure of a junction box according to claim 4, wherein said long slit extends longitudinally with respect to said main body, and said guide slits of said bracket extend in the same direction.

6. A connector connecting structure of a junction box according to claim 5, wherein said guide slits each have a first straight portion, a tapered portion extending from said first straight portion, and a second straight portion extending from said tapered portion, said first and second straight portions being in parallel with the bottom wall of said bracket.

* * * * *